US010153622B1

(12) United States Patent
Uegaki et al.

(10) Patent No.: US 10,153,622 B1
(45) Date of Patent: Dec. 11, 2018

(54) SPARK PLUG HAVING THE THICKNESS OF A MAGNETIC MEMBER WITHOUT EXCESSIVELY NARROWING AN ELECTRODE MEMBER

(71) Applicant: NGK SPARK PLUG CO., LTD., Nagoya-shi, Aichi (JP)

(72) Inventors: Hironori Uegaki, Nagoya (JP); Shoma Tsumagari, Tajimi (JP); Kazuhiro Kurosawa, Gifu (JP); Katsuya Takaoka, Ichinomiya (JP); Kuniharu Tanaka, Komaki (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 16/001,451

(22) Filed: Jun. 6, 2018

(30) Foreign Application Priority Data

Jun. 9, 2017 (JP) ..... 2017-114727

(51) Int. Cl.
*H01T 13/34* (2006.01)
*H01T 13/41* (2006.01)

(52) U.S. Cl.
CPC ..... *H01T 13/41* (2013.01); *H01T 13/34* (2013.01)

(58) Field of Classification Search
CPC ..... H01T 21/02; H01T 13/39; H01T 13/38; H01T 13/20; H01T 13/34; H01T 13/36; H01T 13/467; H01T 13/52
See application file for complete search history.

(56) References Cited

U.S. PATENT DOCUMENTS 9,590,395 B2 * 3/2017 Takaoka ..... F02P 11/00
9,595,814 B2 * 3/2017 Kasashima ..... F02P 11/00
2018/0166861 A1 * 6/2018 Kurosawa ..... H01T 13/20

FOREIGN PATENT DOCUMENTS

JP 62-150681 A 7/1987

* cited by examiner

*Primary Examiner* — Tracie Y Green
(74) *Attorney, Agent, or Firm* — Kusner & Jaffe

(57) ABSTRACT

A spark plug has an insulator, a rod-shaped electrode member disposed in an axial hole of the insulator, and a cylindrical magnetic member disposed on an outer circumference of the electrode member within the axial hole. The insulator includes a large inner diameter region, a middle inner diameter region located frontward of the large inner diameter region and having an inner diameter smaller than that of the large inner diameter region, and a small inner diameter region located frontward of the middle inner diameter region and having an inner diameter smaller than that of the middle inner diameter region. The electrode member is retained on a step portion of the insulator between the middle inner diameter region and the small inner diameter region. The magnetic member is positioned in the axial hole at a location within the large inner diameter region.

6 Claims, 4 Drawing Sheets

EMBODIMENT

EMBODIMENT

COMPARATIVE EXAMPLE

MODIFICATION EXAMPLES

MODIFICATION EXAMPLE

SPARK PLUG HAVING THE THICKNESS OF A MAGNETIC MEMBER WITHOUT EXCESSIVELY NARROWING AN ELECTRODE MEMBER

FIELD OF THE INVENTION

The present invention relates to a spark plug for ignition of a fuel gas in an internal combustion engine.

BACKGROUND OF THE INVENTION

A spark plug is mounted to an internal combustion engine and used to ignite a fuel gas in a combustion chamber of the internal combustion engine. There has been proposed a spark plug in which a magnetic member is disposed in a constant diameter axial hole of an insulator so as to suppress radio noise induced by fuel ignition. See, for example, Japanese Laid-Open Patent Publication No. S62-150681. In this spark plug, the magnetic member is formed in a cylindrical shape with a though hole; and an electrode member (more specifically, a terminal electrode) is inserted in the though hole of the magnetic member.

In the above-proposed spark plug, it is conceivable to increase the thickness of the magnetic member for the purpose of more effectively suppressing radio noise. However, the electrode member may be excessively narrowed with increase in the thickness of the magnetic member. There arises a problem that the excessively narrowed electrode member becomes bent and comes into contact with the magnetic member to thereby cause damage or breakage of the magnetic member. From the viewpoint of avoiding such a problem, it has conventionally been difficult or impossible to ensure the thickness of the magnetic member.

In view of the foregoing, an advantage of the present invention is a spark plug capable of ensuring the thickness of a magnetic member without excessively narrowing an electrode member.

SUMMARY OF THE INVENTION

The present invention can be embodied in the following aspects.

In accordance with a first aspect of the present invention, there is provided a spark plug, comprising:

an insulator having an axial hole formed in a direction of an axis of the spark plug;

a rod-shaped electrode member disposed in the axial hole; and a cylindrical magnetic member disposed on an outer circumference of the electrode member within the axial hole, wherein the insulator includes: a large inner diameter region; a middle inner diameter region located frontward of the large inner diameter region and having an inner diameter smaller than that of the large inner diameter region; and a small inner diameter region located frontward of the middle inner diameter region and having an inner diameter smaller than that of the middle inner diameter region, wherein the electrode member is retained on a first step portion of the insulator between the middle inner diameter region and the small inner diameter region, and wherein the magnetic member is positioned in the axial hole at a location within the large inner diameter region.

In the above configuration, the cylindrical magnetic member is arranged around the electrode member in the axial hole at the location within the large inner diameter region of the insulator. It is therefore possible to ensure the thickness of the magnetic member without the electrode member being excessively narrowed.

In accordance with a second aspect of the present invention, there is provided a spark plug as described above, wherein a front end portion of the magnetic member is supported directly or via another member on a second step portion of the insulator between the large inner diameter region and the middle inner diameter region.

In the above configuration, it is possible to allow easy and proper positioning of the magnetic member in the axial hole.

In accordance with a third aspect of the present invention, there is provided a spark plug as described above, wherein the electrode member comprises: a center electrode constituting a front end part of the electrode member and retained on the first step portion of the insulator; a terminal electrode located rearward of the center electrode and constituting a rear end part of the electrode member; and a seal element connecting the center electrode and the terminal electrode to each other directly or via another element, and wherein the magnetic member is positioned rearward of and spaced apart from the seal element.

In the above configuration, the magnetic member is spaced apart from the seal element so that vibrations of the magnetic member and the like are not transmitted to the seal element. It is thus possible to effectively suppress damage of the seal element.

In accordance with a fourth aspect of the present invention, there is provided a spark plug as described above, further comprising a metal shell surrounding a part of an outer circumference of the insulator so as to cover the middle inner diameter region and a front end part of the large inner diameter region, wherein the spark plug satisfies a relationship of $D1>D2$ where D1 is a minimum thickness of the large inner diameter region in a range where the insulator is surrounded by the metal shell; and D2 is a minimum thickness of the middle inner diameter region in the range where the insulator is surrounded by the metal shell.

In the above configuration, it is possible to effectively prevent the occurrence of a perforation in the large inner diameter region of the insulator.

In accordance with a fifth aspect of the present invention, there is provided a spark plug as described above, further comprising a metal shell surrounding a part of an outer circumference of the insulator, wherein at least a part of the magnetic member is located rearward of a rear end of the metal shell.

The metal shell and the electrode member, which sandwich therebetween the insulator, serve as a capacitor whereby a high frequency component of noise current flows in the insulator. On the other hand, almost all of noise current flows in the electrode member on a side rearward of the rear end of the metal shell. In the above configuration, at least the part of the magnetic member is located rearward of the rear end of the metal shell. It is thus possible to effectively suppress radio noise.

In accordance with a sixth aspect of the present invention, there is provided a spark plug as described above, further comprising a fixing member arranged between the magnetic member and the insulator.

In the above configuration, the magnetic member is prevented by the fixing member from vibrating in the axial hole of the insulator. It is thus possible to effectively suppress breakage of the insulator and the magnetic member due to vibrations.

It should be noted that the present invention can be embodied in various forms such as not only a spark plug but also an ignition device with a spark plug, an internal combustion engine having mounted thereon a spark plug, an internal combustion engine having mounted thereon an ignition device with a spark plug, an electrode member of a spark plug, or the like.

The other objects and features of the present invention will also become understood from the following description.

DETAILED DESCRIPTION OF THE INVENTION

A. Embodiment

A-1. Configuration of Spark Plug

Figure 1:
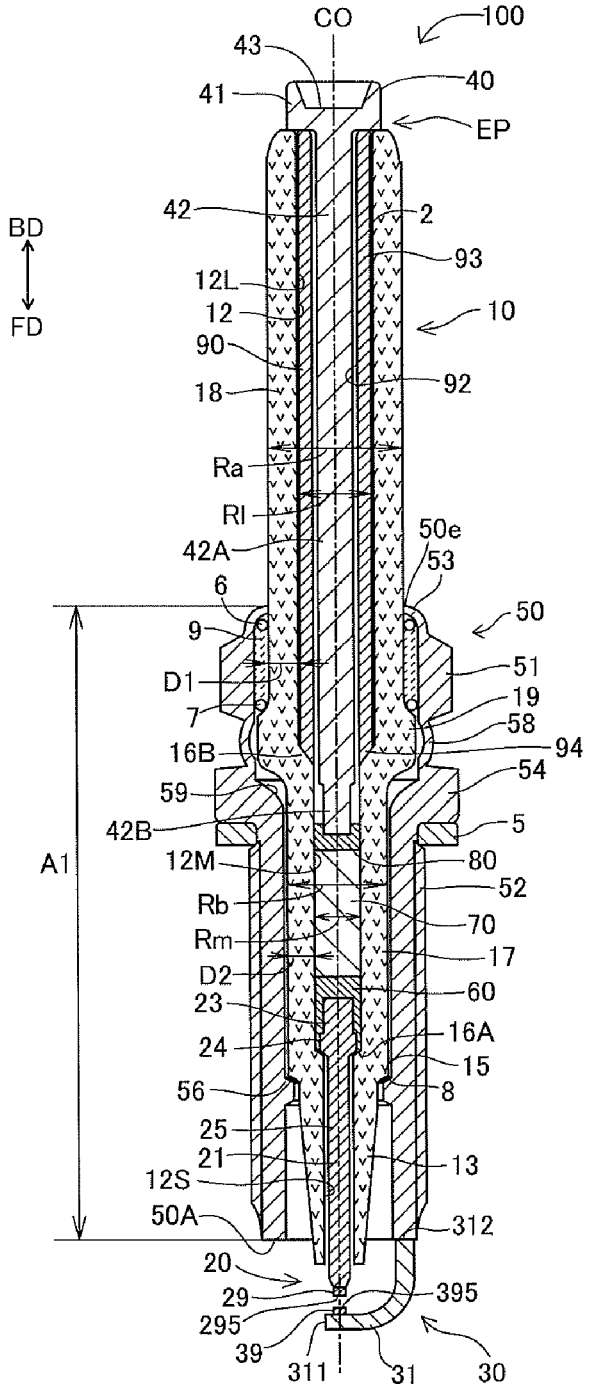
FIG. 1 is a cross-sectional view of a spark plug 100 according to one embodiment of the present invention.

FIG. 1 is a cross-sectional view of a spark plug 100 according to one embodiment of the present invention. In FIG. 1, an axis CO of the spark plug 100 is indicated by a dot-dash line. In the following description, a direction parallel to the axis CO (vertical direction in FIG. 1) is also referred to as "axial direction"; a direction of the radius of a circle about the axis CO is also referred to as "radial direction"; and a direction of the circumference of a circle about the axis CO is also referred to as "circumferential direction". The lower and upper sides in FIG. 1 are respectively correspond to front and rear sides of the spark plug 100. Further, a direction toward the front side (upper side in FIG. 1) along the axis CO is also referred to as "frontward direction FD"; and a direction toward the rear side (lower side in FIG. 1) along the axis CO is also referred to as "rearward direction BD".

The spark plug 100 is mounted to an internal combustion engine and used to ignite a fuel gas in a combustion chamber of the internal combustion engine. As shown in FIG. 1, the spark plug 100 is provided with an insulator 10, a center electrode 20, a ground electrode 30, a terminal electrode 40, a metal shell 50, a resistor 70, conductive seal elements 60 and 80 and a magnetic member 90.

The insulator 10 is substantially cylindrical-shaped, with an axial hole 12 formed therethrough in the axial direction. The insulator 10 is made of e.g. a ceramic material such as alumina.

The insulator 10 includes a collar portion 19, a rear body portion 18, a front body portion 17, a diameter decrease portion 15 and a leg portion 13. The collar portion 19 is located at a substantially middle position of the insulator 10 in the axial direction. The rear body portion 18 is located rearward of the collar portion 19 and made smaller in outer diameter than the collar portion 19. The front body portion 17 is located frontward of the collar portion 19 and has an outer diameter smaller than that of the collar portion 19. The leg portion 13 is located frontward of the front body portion 17 and has an outer diameter smaller than that of the front body portion 17 and gradually decreasing toward the front side. In a state that the spark plug 100 is mounted to the internal combustion engine, the leg portion 13 is exposed to the inside of the engine combustion chamber. The diameter decrease portion 15 is formed between the leg portion 13 and the front body portion 17 and has an outer diameter decreasing from the rear side toward the front side.

From the viewpoint of the inner circumferential shape of the insulator 10, the insulator 10 has a large inner diameter region 12L, a middle inner diameter region 12M and a small inner diameter region 12S. The large inner diameter region 12L is located rearmost of the insulator 10. An inner diameter of the large inner diameter region 12L (that is, a diameter of the axial hole 12 within the large inner diameter region 12L) is largest in the insulator 10. The middle inner diameter region 12M is located frontward of the large inner diameter region 12L and is smaller in inner diameter than the large inner diameter region 12L. The small inner diameter region 12S is located frontward of the middle inner diameter region 12M and is smaller in inner diameter than the middle inner diameter region 12M.

There is a first step portion 16A formed between the middle inner diameter region 12M and the small inner diameter region 12S. The first step portion 16A has an inner diameter gradually decreasing from the rear side toward the front side. In the present embodiment, the position of the first step portion 16A in the axial direction corresponds to that of a front end part of the front body portion 17. There is also a second step portion 16B formed between the large inner diameter region 12L and the middle inner diameter region 12M. The second step portion 16B has an inner diameter gradually decreasing from the rear side toward the front side. In the present embodiment, the position of the second step portion 16B in the axial direction corresponds to that of the collar portion 19.

Namely, the large inner diameter region 12L ranges from a rear end of the rear body portion 18 to a rear end part of the collar portion 19; the middle inner diameter region 12M ranges from a front end part of the collar portion 19 to the vicinity of a front end of the front body portion 17; and the small inner diameter region 12S ranges from the vicinity of the front end of the front body portion 17 to the front end of the leg portion 13.

The metal shell 50 is made of a conductive metal material (such as low carbon steel) in a cylindrical shape and is adapted for fixing the spark plug 100 to an engine head (not shown) of the internal combustion engine. A through hole 59 is formed through the metal shell 50 along the axis CO. The metal shell 50 is arranged to surround a part of the outer circumference of the insulator 10 (in the present embodiment, cover the middle inner diameter region 12M and a front end part of the large inner diameter region 12L). In other words, the insulator 10 is inserted and held in the through hole 59 of the metal shell 50, with a front end of the insulator 10 protruding toward the front from a front end 50A of the metal shell 50 and a rear end of the insulator 10 protruding toward the rear from a rear end 50*e* of the metal shell 50.

The metal shell 50 includes a hexagonal column-shaped tool engagement portion 51 for engagement with a spark plug wrench, a mounting thread portion 51 for screw mounting to the internal combustion engine and a collar-shaped seat portion 54 formed between the tool engagement portion 51 and the mounting thread portion 52. A diagonal length of the tool engagement portion 51 (that is, a distance between parallel side surfaces of the tool engagement portion 51) is set to e.g. 9 mm to 16 mm. A nominal diameter of the mounting thread portion 52 is set to e.g. M8 (8 mm) to M14 (14 mm).

An annular metallic gasket 5 is fitted on a part of the metal shell 50 between the mounting thread portion 52 and the seat portion 54. In a state that the spark plug 100 is mounted to the internal combustion engine, the gasket 5 is held between the seat portion 54 and the engine head so as to seal a clearance between the spark plug 100 and the internal combustion engine.

The metal shell 50 further includes a thin crimp portion 53 located rearward of the tool engagement portion 51, a thin compression deformation portion 58 located between the seat portion 54 and the tool engagement portion 51, and a step portion 56 formed on an inner circumferential side of the metal shell 50 at a position corresponding to the mounting thread portion 52.

Annular ring members 6 and 7 are disposed in an annular space between an inner circumferential surface of a part of the metal shell 50 from the tool engagement portion 51 to the crimp portion 51 and an outer circumferential surface of the rear body portion 18 of the insulator 10. A powder of talc 9 is filled between the ring members 6 and 7 in the annular space. A rear end of the crimp portion 53 is crimped radially inwardly and fixed to the outer circumferential surface of the insulator 10. The compression deformation portion 58 is compression-deformed as the crimp portion 53 is fixed to the outer circumferential surface of the insulator 10 and pushed toward the front during manufacturing of the spark plug 100. With such compression deformation, the insulator 10 is pushed toward the front via the ring members 6 and 7 and the talc 9 within the metal shell 50. As a result, the diameter decrease portion 15 of the insulator 10 is pressed against the step portion 56 of the metal shell 50 via an annular metal plate packing 8 so as to prevent gas in the combustion chamber of the internal combustion engine from leaking to the outside through between the metal shell 50 and the insulator 10.

The magnetic member 90 is substantially cylindrical-shaped, with a through hole 92 formed therethrough in the axial direction, and is disposed in the axial hole 12 of the insulator 10. The magnetic member 90 is produced by sintering a powder of magnetic material such as ferrite or sendust. For example, the magnetic member 90 can be in the form of a sintered body containing a powder of magnetic material and a powder of any other metal material. The magnetic member 90 can alternatively be made of a resin (such as silicon resin) in which with a powder of magnetic material is mixed. Herein, the magnetic member 90 performs the function of attenuating radio noise induced by spark discharge, in particular, a high-frequency component of the radio noise.

The magnetic member 90 includes a body portion 93 situated within the large inner diameter region 12L and a front end portion 94 located frontward of the body portion 93. The front end portion 94 has an outer diameter gradually decreasing from the rear side to the front side along the second step portion 16B of the insulator 10, and is supported by the second step portion 16B from the front side. By contact of the front end portion 94 with the second step portion 16B, the magnetic member 90 is placed in position within the axial hole 12.

In the present embodiment, a length of the magnetic member 90 in the axial direction is made substantially equal to a length of the large inner diameter region 12L in the axial direction. As a consequence, a rear end of the magnetic member 90 (i.e. a rear end of the body portion 93) substantially corresponds in position to the rear end of the insulator (i.e. the rear end of the rear body portion 18). In this way, the magnetic member 90 is arranged within the large inner diameter region 12L and is not arranged within the middle inner diameter region 12M and the small inner diameter region 12S.

Further, the rear end of the magnetic member 90 is located rearward of the rear end 50*e* of the metal shell 50. In other words, a part of the magnetic member 90 (more specifically, a rear end part of the body portion 93) is located rearward of the rear end of the metal shell 50*e*.

An outer diameter of the body portion 93 is made slightly smaller than the inner diameter of the large inner diameter region 12L of the insulator 10. A fixing member 2 is arranged between the body portion 93 and the insulator 10 (large inner diameter region 12L) such that the body portion 93 and the insulator 10 are fixed in position by the fixing member 2. For example, the fixing member 2 can be in the form of an adhesive material such as a heat-resistant inorganic adhesive (e.g. Aron Ceramic available from TOAGOSEI CO., LTD.). A glass material such as $B_2O_3$—$SiO_2$ glass may alternatively be used as the fixing member 2.

An inner diameter of the magnetic member 90 (that is, a diameter of the through hole 92) is made substantially equal to the inner diameter of the middle inner diameter region 12M of the insulator 10.

The center electrode 20 has a rod-shaped center electrode body 21 extending in the axial direction and a center electrode tip 29 joined to a front end of the center electrode body 21.

The center electrode body 21 is held in a front side of the axial hole 12 of the insulator 10. In other words, a rear end of the center electrode 20 (i.e. rear end of the center electrode body 21) is located inside the axial hole 12. The center electrode body 21 is made of a highly corrosion- and heat-resistant metal material such as nickel (Ni) or Ni-based alloy (e.g. NCF600 or NCF601). Alternatively, the center electrode body 21 may have a two-layer structure consisting of a base material of Ni or Ni-based alloy and a core embedded in the base material. In this alternative case, the core is made of e.g. copper or copper-based alloy having a higher thermal conductivity than that of the base material.

The center electrode body 21 includes a collar portion 24 located at a predetermined position in the axial direction, a head portion 23 (as an electrode head) located rearward of the collar portion 24 and a leg portion 25 (as an electrode leg) located frontward of the collar portion 24. The collar portion 24 is supported by the first step portion 16A of the insulator 10 from the front side such that the center electrode 20 is held in position within the axial hole 12 of the insulator 10, with a front end of the leg portion 25 (i.e. a front end of the center electrode body 21) protruding toward the front from the front end of the insulator 10.

The center electrode tip 29 is substantially cylindrical column-shaped and joined by e.g. laser welding to the front end of the center electrode body 21 (leg portion 25). A front end surface of the center electrode tip 29 serves as a first discharge surface 295 that defines a spark gap with the after-mentioned ground electrode tip 39. The center electrode tip 29 is made of a high-melting noble metal such as iridium (Ir) or platinum (Pt) or noble metal-based alloy.

The terminal electrode 40 is rod-shaped along the axial direction and inserted in the through hole 92 of the magnetic member 90 from the rear side. In other words, the terminal electrode 40 is located rearward of the center electrode 20 within the axial hole 12. The terminal electrode 40 is made of a conductive metal material (such as low carbon steel). For prevention of corrosion, a plating layer of Ni or the like may be applied to a surface of the terminal electrode 40.

The terminal electrode 40 includes a head portion 41 and a leg portion 42 located frontward of the head portion 21. The head portion 41 is exposed to the outside from the rear end of the insulator 10. A recess 43 is formed in the head portion 41 such that a power supply member (such as spring member; not shown) is brought into contact with and engaged in the recess 43. A high voltage for generation of spark discharge is applied to the terminal electrode 40 through the power supply member. The leg portion 42 is situated in the axial hole 12 of the insulator 10. In the present embodiment, the leg portion 42 has a large diameter region 42A and a front end region 42B located frontward of the large diameter region 42A and made smaller in outer diameter than the large diameter region 42A. A rear major part of the large diameter region 42A is positioned in the axial hole 12 of the insulator 10 and in the through hole 92 of the magnetic member 90. The remaining front end part of the large diameter region 42A and the front end region 42B are positioned frontward of a front end of the magnetic member 90 within the axial hole 12.

The resistor 70 is disposed between the front end of the terminal electrode 40 and the rear end of the center electrode 20 within the axial hole 12 of the insulator 10. The resistor 70 has a resistance of, for instance, 1 KΩ or higher (e.g. 5 KΩ) and performs the function of reducing radio nose induced by spark discharge. The resistor 70 is made of e.g. a composition containing glass particles as a main component, particles of ceramic other than glass and a conductive material.

The conductive seal element 60 is arranged to fill a space between the resistor 70 and the center electrode 20 within the axial hole 12, whereas the conductive seal element 80 is arranged to fill a space between the resistor 70 and the terminal electrode 40 within the axial hole 12. Namely, the seal element 60 is held between and brought into contact with the center electrode 20 and the resistor 70 so as to separate the center electrode 20 and the resistor 70 from each other; and the seal element 80 is held between and brought into contact with the terminal electrode 40 and the resistor 70 so as to separate the terminal electrode 40 and the resistor 70 from each other. The center electrode 20 and the terminal electrode 40 are electrically and physically connected to each other by these seal elements 60 and 80 via the resistor 70. Each of the seal elements 60 and 80 is made of e.g. a composition containing particles of glass (such as $B_2O_3$—$SiO_2$ glass) and particles of metal (such as Cu, Fe).

The ground electrode 30 has a ground electrode body 31 and a ground electrode tip 39 joined to the ground electrode body 31.

The ground electrode body 31 is formed in a rectangular cross-sectional rod shape with two opposite end surfaces: a joint end surface 312 and a free end surface 311 located opposite from the joint end surface 312. The joint end surface 312 of the ground electrode body 31 is joined by e.g. resistance welding to the front end 50A of the metal shell 50 so that the metal shell 50 and the ground electrode 50 are electrically connected to each other. The ground electrode body 30 is bent by about 90° at a middle portion thereof such that a part of the ground electrode body 31 in the vicinity of the joint end surface 312 extends in the axial direction and such that a part of the ground electrode body 31 in the vicinity of the free end surface 311 extends in a direction perpendicular to the axial direction. The ground electrode body 31 is made of a highly corrosion- and heat-resistant metal material such as nickel (Ni) or Ni-based alloy (e.g. NCF600 or NCF601). Alternatively, the ground electrode body 31 may have a two-layer structure consisting of a base material and a core embedded in the base material and having a higher thermal conductivity than that of the base material as in the case of the center electrode body 21.

The ground electrode tip 39 is formed in a cylindrical or rectangular column shape and joined to a free end portion of the ground electrode body 31 such that a second discharge surface 395 of the ground electrode tip 39 faces the first discharge surface 295 of the center electrode tip 29 to define therebetween the spark gap in which spark discharge occurs. As in the case of the center electrode tip 29, the ground electrode tip 39 is made of a high-melting noble metal or noble metal-based alloy.

As is clear from the above description, the terminal electrode 40, the center electrode 20, the resistor 70 and the seal elements 60 and 80 constitutes a rod-shaped electrode member (or assembly) EP within the axial hole 12 of the insulator 10. Further, the magnetic member 90 is arranged on the outer circumference of the electrode member EP (in the present embodiment, the terminal electrode 40 of the electrode member EP) within the axial hole 12 of the insulator 10.

A-2. Characteristic Features of Spark Plug

In the present embodiment, the magnetic member 90 is arranged within the large inner diameter region 12L of the insulator 10; and the seal element 60, 80 is arranged within the middle inner diameter region 12M of the insulator 10. The magnetic member 90 is hence positioned rearward of and spaced apart from the seal element 60, 80. The front end portion 94 of the magnetic member 90 is not in contact with e.g. the seal element 60.

It is herein assumed that: A1 is a range where the outer circumference of the insulator 10 is surrounded by the metal shell 50; D1 is a minimum thickness of the large inner diameter region 12L in the range A1; and D2 is a minimum thickness of the middle inner diameter region 12M in the range A1. In the present embodiment, the minimum thickness D1 of the large inner diameter region 12L in the range A1 refers to the thickness of the rear body portion 18A because the large inner diameter region 12L corresponds in position to the rear end part of the insulator 10 from the rear body portion 18 to the collar portion 19; and the rear body portion 18 has an outer diameter smaller than that of the collar portion 19. Further, the minimum thickness D2 of the middle inner diameter region 12M in the range A1 can be simply referred to as the minimum thickness D2 of the middle inner diameter region 12M because the whole outer circumference of the middle inner diameter region 12M is surrounded by the metal shell 50 in the present embodiment.

In the present embodiment, the minimum thickness D1 is preferably set larger than the minimum thickness D2 (D1>D2). In order to satisfy the relationship of D1>D2, the insulator 10 is shaped to meet the following conditions:

(A) the front end of the large inner diameter region 12L is located rearward of the front end of the collar portion 19; and (B) the following relational expression holds: $(R_a-R_l)>(R_b-R_m)$ where $R_a$ is the outer diameter of the rear body portion 18; $R_b$ is the outer diameter of the front body portion 17; $R_l$ is the inner diameter of the large inner diameter region 12L; and $R_m$ is the inner diameter of the middle inner diameter region 12M.

When the condition (A) is met, the thickness of the rear body portion 18 and the thickness of the front body portion 17 are determined as the minimum thicknesses D1 and D2, respectively. In this case, the following equations hold:

$D1=(R_a-R_l)/2$ and $D2=(R_b-R_m)/2$. Thus, the relationship of D1>D2 is satisfied when the condition (B) is met in addition to the condition (A).

As described above, the spark plug 100 according to the present embodiment is so structured that: the insulator 10 is provided with three (large, middle and small) inner diameter regions 12L, 12M and 12S; the electrode member EP is retained on the first step portion 16A of the insulator 10 between the middle inner diameter region 12M and the small inner diameter region 12S; and the magnetic member 90 is positioned in the axial hole 12 of the insulator 10 at a location within the large inner diameter region 12L. In this configuration, it is possible to ensure the thickness of the magnetic member 90 without the electrode member EP (more specifically, the leg portion 42 of the terminal electrode 40) being excessively narrowed.

Figure 2:
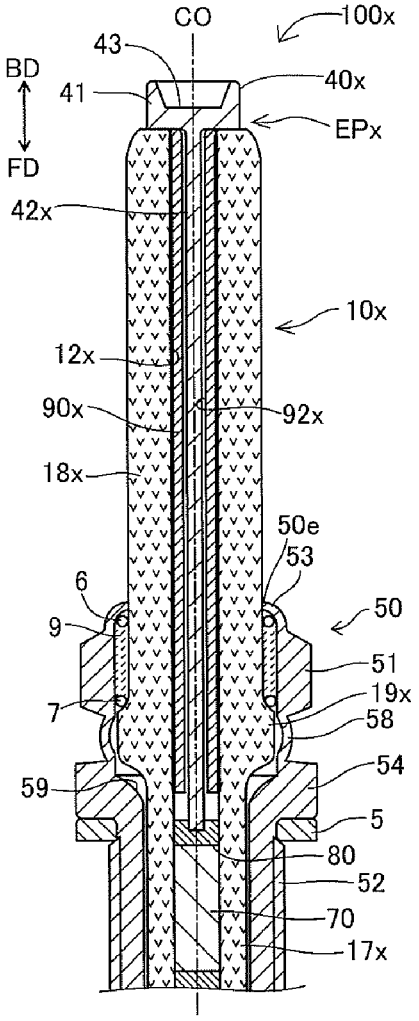
FIG. 2 is a schematic view of a conventional spark plug 100*x* as a comparative example.

FIG. 2 is a schematic view of a conventional spark plug 100*x* as a comparative example. The conventional spark plug 100*x* is structurally the same as the spark plug 100, except for the configurations of an insulator 10*x* and a magnetic member 90*x*. In FIG. 2, the same parts and portions of the conventional spark plug 100*x* as those of the spark plug 100 of FIG. 1 are designated by like reference numerals to omit repeated explanations thereof.

In the conventional spark plug 100*x*, the insulator 10*x* has an axial hole 12*x* of constant diameter throughout the front body portion 17*x*, the rear body portion 18*x* and the collar portion 19*x*. In the comparative example of FIG. 2, the inner diameter of the insulator 10*x* is equal to the inner diameter of the middle inner diameter region 12M. It is thus difficult, in a state that the magnetic member 90*x* is disposed in the axial hole 12*x*, to ensure the sufficient thickness of a leg portion 42*x* of the terminal electrode 40*x* while ensuring the sufficient thickness of the magnetic member 90*x* as shown in FIG. 2. When the thickness of the magnetic member 90*x* is ensured in preference to the thickness of the leg portion 42*x*, for example, the leg portion 42 becomes excessively narrowed. When the thickness of the leg portion 42 is ensured in preference to the thickness of the magnetic member 90*x*, by contrast, the magnetic member 90*x* becomes excessively narrowed.

The higher the radio noise suppression ability of the magnetic member, the larger the thickness of the magnetic member. It becomes difficult to sufficiently suppress radio noise in the case where the thickness of the magnetic member 90*x* cannot be secured in the conventional spark plug 100*x*. The occurrence of radio noise can result in a malfunction of electronic equipment (such as sensor, microcomputer etc.) in an internal combustion engine or a vehicle equipped therewith.

In the process of manufacturing of the spark plug, raw material powders of the seal elements 60 and 80 and the resistor 70 are sintered by heating while being pressurized by the front end of the terminal electrode. In the case where the leg portion 42*x* of the terminal electrode 40*x* is excessively narrowed in the conventional spark plug 100*x*, the leg portion 42 is likely to be bent and come into contact with the magnetic member 90*x* during the pressurization. The magnetic member 90*x* can be damaged (e.g. cracked) by contact with the leg portion 42*x*. Furthermore, the raw material powders may not be sufficiently pressurized by the leg portion 42 so that it becomes difficult to achieve adequate sintering of the raw material powders in the case where the leg portion 42 is excessively narrowed.

The spark plug 100 according to the present embodiment is advantageous over the comparative spark plug 100*x* in that the spark plug 100 ensures the thickness of the magnetic member 90, without excessively narrowing the leg portion 42 of the terminal electrode 40, and avoids the above problems.

In the present embodiment, the front end portion 94 of the magnetic member 90 is directly supported on the second step portion 16B of the insulator 10. It is thus possible to allow easy and proper positioning of the magnetic member 90 in the axial hole 12.

Further, the magnetic member 90 is positioned rearward of and spaced apart from the seal element 80 in the present embodiment. When there occurs a crack between the seal element 80 and the terminal electrode 40 (leg portion 42) due to transmission of vibrations from the magnetic member 90, for example, the contact of the seal element 80 and the terminal electrode 40 becomes poor. Such poor contact results in a change of the resistance between the terminal electrode 40 and the center electrode 20 so that the spark plug 100 may not attain desired performance. In the present embodiment, however, the magnetic member 90 is spaced apart from the seal element 80 so that vibrations of the magnetic member 90 and the like are not transmitted to the seal element 80. It is thus possible to effectively suppress damage of the seal element 80.

Furthermore, the spark plug 10 is configured to satisfy the relationship of D1>D2 in the present embodiment. For example, when the inner diameter of the large inner diameter region 12L is excessively large, the thickness of the magnetic member 90 can be increased. On the other hand, the thickness of the large inner diameter region 12L of the insulator 10 becomes excessively small so that the spark plug fails to satisfy the relationship of D1>D2, In this case, it is likely that a perforation (electrical breakdown) will occur in the large inner diameter region 12L. It is however possible to effectively prevent the occurrence of such a perforation in the insulator 10 as the relationship of D1>D2 is satisfied in the present embodiment.

In the present embodiment, a part of the magnetic member 90 is located rearward of the rear end 50*e* of the metal shell 50. In the range A1 that the outer circumference of the insulator 10 is surrounded by the metal shell 50, the conductive metal member 50 and the conductive electrode member EP, which sandwich therebetween the dielectric insulator 10, serve as a capacitor whereby a high frequency component of noise current (i.e. alternating current) flows in the insulator 10. On the other hand, almost all of noise current flows in the electrode member EP (terminal electrode 40) on a side rearward of the rear end 50*e* of the metal shell 50. As at least the part of the magnetic member 90 is located rearward of the rear end 50*e* of the metal shell 50, it is possible to effectively suppress radio noise.

In addition, the fixing member 2 is arranged between the magnetic member 90 and the insulator 10 in the present embodiment. As the magnetic member is prevented by the fixing member 2 from vibrating within the axial hole 12 of the insulator 10, it is possible to effectively suppress breakage of the insulator 10 and the magnetic member 90 due to vibrations.

B. Modification Examples

The above-mentioned configuration of the spark plug 100 (in particular, the magnetic member 90 and the large and middle inner diameter regions 12L and 12M of the insulator 10 corresponding to the magnetic member 90) is a mere example and is not limited to such a mere example. For example, the following modification examples are possible.

FIGS. 3A, 3B, 3C and 4 are schematic views of spark plugs 100*b*, 100*c*, 100*d* and 100*e* according to the first to fourth modification examples of the above embodiment. The spark plugs 100*b*, 100*c*, 100*d* and 100*e* according to the first to fourth modification examples are each different from the spark plug 100 according to the above embodiment, in the configuration of a magnetic member 90*b*, 90*c*, 90*d*, 90*e* and/or an insulator 10*b*, 10*c*. The other parts and portions of the spark plugs 100*b*, 100*c*, 100*d* and 100*e* are the same in configuration as those of the spark plug 100 and thus are designated by like reference numerals to omit detailed explanations thereof.

Figure 3A:
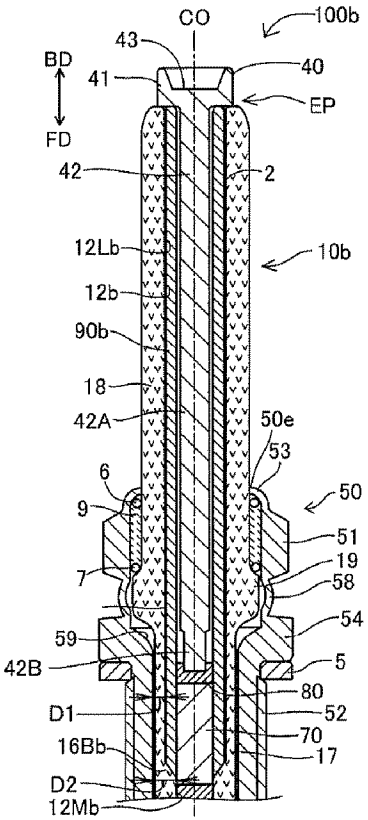
FIGS. 3A to 3C are schematic views showing modification examples of the spark plug 100.

Although the spark plug 100 is configured to satisfy the relationship of D1>D2 in the above embodiment, the relationship of D1>D2 is not necessarily satisfied. According to the first modification example, there is provided the spark plug 100*b* which satisfies a relationship of D1<D2, rather than D1>D2, as shown in FIG. 3A. More specifically, the second step portion 16Bb of the insulator 10*b* of the spark plug 100*b* is located at a more frontward position as compared with the second step portion 16B of the insulator 10 of the above embodiment (see FIG. 1) and is formed in the location range of the front body portion 17 in the axial direction. Thus, the large inner diameter region 12Lb of the insulator 10*b* is longer in the axial direction than the large inner diameter region 12L of the insulator 10 of the above embodiment; and the middle inner diameter region 12Mb of the insulator 10*b* is shorter in the axial direction than the middle inner diameter region 12M of the insulator 10 of the above embodiment. Further, the length of the magnetic member 90*b* in the axial direction is substantially equal to the length of the large inner diameter region 12Lb in the axial direction. The front end of the magnetic member 90*b* is thus situated in the location range of the front body portion 17 in the axial direction. As the front end of the large inner diameter region 12Lb is located frontward of the front end of the collar portion 19, the insulator 10*b* does not meet the above-mentioned condition (A). In this configuration, the minimum thickness D1 of the large inner diameter region 12Lb refers to the thickness of the rear end part of the front body portion 17; and the minimum thickness D2 of the middle inner diameter region 12Mb refers to the thickness of the rear end part of the front body portion 17 as shown in FIG. 3A. The relationship of D1<D2 is consequently satisfied in the first modification example.

Figure 3B:
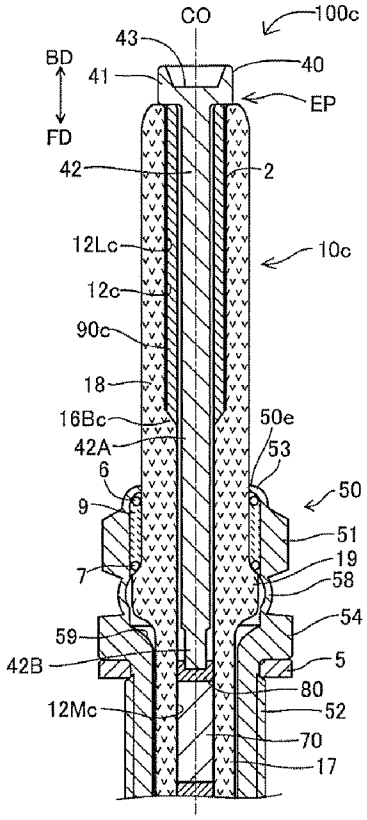

In the above embodiment, the rear end part of the magnetic member 90 is located rearward of the rear end 50*e* of the metal shell 50. Alternatively, there is provided the spark plug 100*c* according to the second modification example, in which the whole of the magnetic member 90*c* is located rearward of the rear end 50*e* of the metal shell 50 as shown in FIG. 3B. More specifically, the second step portion 16Bc of the insulator 10*c* of the spark plug 100*c* is located at a more rearward position as compared with the second step portion 16B of the insulator 10 of the above embodiment (see FIG. 1) and is situated rearward of the rear end 50*e* of the metal shell 50. Thus, the large inner diameter region 12Lc of the insulator 10*c* is shorter in the axial direction than the large inner diameter region 12L of the insulator 10 of the above embodiment; and the middle inner diameter region 12Mc of the insulator 10*c* is longer in the axial direction than the middle inner diameter region 12M of the insulator 10 of the above embodiment. Further, the length of the magnetic member 90*c* in the axial direction is substantially equal to the length of the large inner diameter region 12Lc in the axial direction. The front end of the magnetic member 90*c* is thus located rearward of the rear end 50*e* of the metal shell 50. Namely, the whole of the magnetic member 90*c* is located rearward of the rear end 50*e* of the metal shell 50 in the second modification example.

Figure 3C:
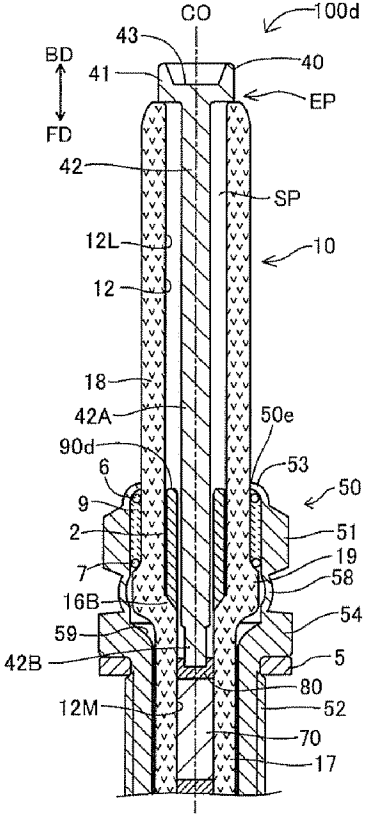

As mentioned above, the rear end part of the magnetic member 90 is located rearward of the rear end 50*e* of the metal shell 50 in the above embodiment. As another alternative, there is provided the spark plug 100*d* according to the third modification example, in which the whole of the magnetic member 90*d* is located frontward of the rear end 50*e* of the metal shell 50 as shown in FIG. 3C. The insulator 10 of the spark plug 100*d* is the same as that of the above embodiment, whereas the rear end of the magnetic member 90*d* of the spark plug 100*d* is situated frontward of the rear end 50*e* of the metal shell 50. Thus, the length of the large inner diameter region 12L of the insulator 10 in the axial direction is the same as that of the above embodiment. On the other hand, the length of the magnetic member 90*d* in the axial direction is shorter than that of the magnetic member 90 of the above embodiment. As a consequence, there appears a space SP in the large inner diameter region 12L at a location rearward of the rear end of the magnetic member 90*d* in the spark plug 100*d* of the third modification example even though such a space SP does not exist in the spark plug 100 of the above embodiment. It is preferable that the space SP does not exist because the space SP allows for an increase in the amplitude of vibrations of the terminal electrode 40. The spark plug 100 of the above embodiment would be hence able to suppress vibrations of the terminal electrode 40 more effectively than the spark plug 100*d*.

Figure 4:
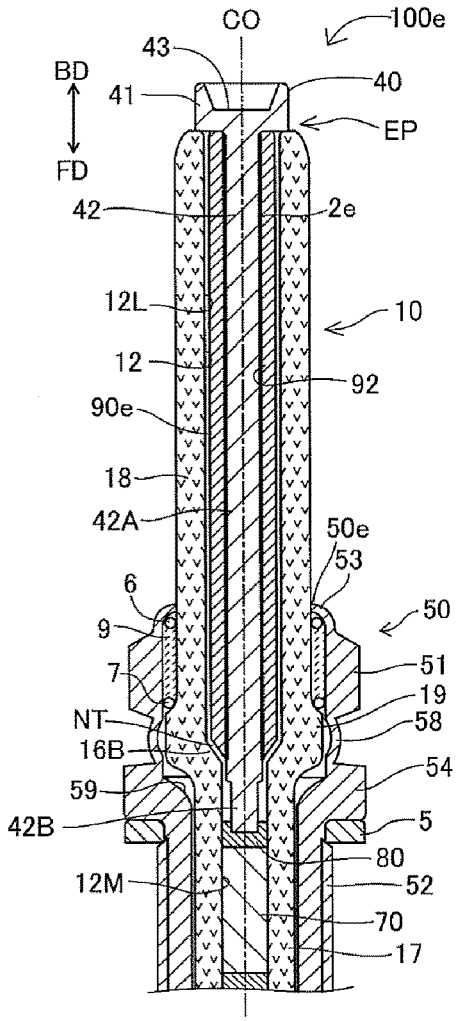
FIG. 4 is a schematic view showing another modification example of the spark plug 100.

In the above embodiment, the front end of the magnetic member 90 is supported on the second step portion 16B of the insulator 10. However, the front end of the magnetic member 90 is not necessarily supported on the second step portion 16B of the insulator 10. Further, the fixing member 2 is arranged between the magnetic member 90 and the insulator 10 in the above embodiment. The fixing member 2 is however not necessarily arranged between the magnetic member 90 and the insulator 10. According to the fourth modification example, there is provided the spark plug 100*e* in which: the front end of the magnetic member 90*e* is not supported on the second step portion 16B of the insulator 10; and no fixing member is arranged between the magnetic member 90*e* and the insulator 10 as shown in FIG. 4. In the spark plug 100*e*, the inner diameter of the magnetic member 90*e* is slightly smaller than that of the magnetic member 90 of the spark plug 100 and slightly larger than the outer diameter of the leg portion 42 of the terminal electrode 40. A fixing member 20*e* is arranged between an inner circumferential surface of the magnetic member 90*e* and an outer circumferential surface of the leg portion 42 of the terminal electrode 40. An inorganic adhesive can used as the fixing member 2*e* as in the case of the above embodiment. However, no fixing member is arranged between the magnetic member 90*e* and the insulator 10 in the fourth modification example. Further, there is a clearance NT left between the front end of the magnetic member 90*e* and the second step portion 16B of the insulator 10. Namely, the front end of the magnetic member 90*e* is not supported on the second step portion 16B of the insulator 10 in the fourth modification example.

Although the front end of the magnetic member 90 is directly supported on the second step portion 16B of the insulator 10 in the above embodiment, the front end of the magnetic member 90 may be supported on the second step portion 16B of the insulator 10 via another member. For example, it is feasible to arrange an anti-vibration packing or fixing member between the front end of the magnetic member 90 and the second step portion 16B of the insulator 10.

In the above embodiment, the center electrode 20 and the terminal electrode 40 are connected by two seal elements 60 and 80 via the resistor 70. The electrode member EP is however not limited to such a structure. The resistor 70 may be omitted so that the center electrode 20 and the terminal electrode 40 are connected by one seal element. The electrode member EP does not necessarily include two electrodes 20 and 40 and may alternatively be provided in the form of a single rod-shaped metal piece.

The spark discharge part of the spark plug 100 is not limited to that of the above embodiment and can be modified to various forms. For example, the spark plug may be of the type in which the ground electrode 30 and the center electrode 20 are opposed to each other in the direction perpendicular to the axial direction so as to define the spark gap therebetween. Further, the materials of the insulator 10, the terminal electrode 40 and the like are not limited to those of the above embodiment. For example, the insulator 10 may be made of a ceramic material containing any other compound (such as AlN, $ZrO_2$, SiC, $TiO_2$ or $Y_2O_3$) as a main component in place of alumina ($Al_2O_3$).

Although the present invention has been described with reference to the above embodiment and modification examples, the above embodiment and modification examples are intended to facilitate understanding of the present invention and are not intended to limit the present invention thereto. Various changes and modifications can be made to the above embodiment and modification examples without departing from the scope of the present invention.

The entire contents of Japanese Patent Application No. 2017-114727 (filed on Jun. 9, 2017) are herein incorporated by reference. The scope of the invention is defined with reference to the following claims.

Having described the invention, the following is claimed:

1. A spark plug, comprising:

an insulator having an axial hole formed in a direction of an axis of the spark plug;

a rod-shaped electrode member disposed in the axial hole; and a cylindrical magnetic member disposed on an outer circumference of the electrode member within the axial hole, wherein the insulator includes: a large inner diameter region; a middle inner diameter region located frontward of the large inner diameter region and having an inner diameter smaller than that of the large inner diameter region; and a small inner diameter region located frontward of the middle inner diameter region and having an inner diameter smaller than that of the middle inner diameter region, wherein the electrode member is retained on a first step portion of the insulator between the middle inner diameter region and the small inner diameter region, and wherein the magnetic member is positioned in the axial hole at a location within the large inner diameter region.

2. The spark plug according to claim 1, wherein a front end portion of the magnetic member is supported directly or via another member on a second step portion of the insulator between the large inner diameter region and the middle inner diameter region.

3. The spark plug according to claim 2 wherein the electrode member comprises: a center electrode constituting a front end part of the electrode member and retained on the first step portion of the insulator; a terminal electrode located rearward of the center electrode and constituting a rear end part of the electrode member; and a seal element connecting the center electrode and the terminal electrode to each other directly or via another element, and wherein the magnetic member is positioned rearward of and spaced apart from the seal element.

4. The spark plug according to claim 1, further comprising a metal shell surrounding a part of an outer circumference of the insulator so as to cover the middle inner diameter region and a front end part of the large inner diameter region, wherein the spark plug satisfies a relationship of D1>D2 where D1 is a minimum thickness of the large inner diameter region in a range where the insulator is surrounded by the metal shell; and D2 is a minimum thickness of the middle inner diameter region in the range where the insulator is surrounded by the metal shell.

5. The spark plug according to claim 1, further comprising a metal shell surrounding a part of an outer circumference of the insulator, wherein at least a part of the magnetic member is located rearward of a rear end of the metal shell.

6. The spark plug according to claim 1, further comprising a fixing member arranged between the magnetic member and the insulator.

* * * * *